US007028615B2

(12) United States Patent
Mayer et al.

(10) Patent No.: US 7,028,615 B2
(45) Date of Patent: Apr. 18, 2006

(54) GRAVURE PROCESS FOR PRINTING ADJACENT COLOR SURFACES WITH VARIOUS COLOR COATING THICKNESSES

(75) Inventors: Karlheinz Mayer, Augsburg (DE); Roger Adamczyk, Munich (DE); Eduard Wisjak, Vaterstetten (AT); Peter Franz, Bruck (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 11/119,933

(22) Filed: May 3, 2005

(65) Prior Publication Data

US 2005/0193909 A1 Sep. 8, 2005

Related U.S. Application Data

(62) Division of application No. 09/787,919, filed as application No. PCT/EP99/07216 on Sep. 29, 1999, now Pat. No. 6,928,925.

(30) Foreign Application Priority Data

Oct. 2, 1998 (DE) ..... 198 45 436

(51) Int. Cl.
*B41M 1/10* (2006.01)
*B41C 1/02* (2006.01)

(52) U.S. Cl. ..... 101/150; 101/170; 101/395

(58) Field of Classification Search ..... 101/150
See application file for complete search history.

(56) References Cited

U.S. PATENT DOCUMENTS

| | | | | |
|---|---|---|---|---|
| 3,599,153 | A | 8/1971 | Lewis et al. | |
| 4,023,971 | A | 5/1977 | Vested | |
| 4,108,659 | A | 8/1978 | Dini | |
| 4,124,947 | A | 11/1978 | Kuhl et al. | |
| 4,294,650 | A * | 10/1981 | Werthmann | 216/54 |
| 4,564,409 | A | 1/1986 | Kuhl | |
| 4,968,064 | A | 11/1990 | Mancuso | |
| 5,435,247 | A | 7/1995 | Giori et al. | |
| 5,675,420 | A | 10/1997 | Jackson et al. | |
| 5,722,693 | A | 3/1998 | Wicker | |
| 5,757,550 | A | 5/1998 | Gulick, Jr. | |
| 6,840,721 | B1 * | 1/2005 | Kaule et al. | 409/132 |

FOREIGN PATENT DOCUMENTS

| | | |
|---|---|---|
| DE | 2130914 | 1/1972 |
| DE | 2603558 | 5/1977 |
| EP | 0 466 433 A2 | 1/1992 |
| GB | 1390302 | 4/1975 |
| WO | 97/48555 | 12/1997 |

* cited by examiner

*Primary Examiner*—Andrew H. Hirshfeld
*Assistant Examiner*—Joshua Zimmerman
(74) *Attorney, Agent, or Firm*—Bacon & Thomas, PLLC

(57) ABSTRACT

A data medium having a printed image is created by the intaglio printing process. The printed image has at least one first ink area with a first ink layer thickness and at least one second ink area with a second ink layer thickness adjacent to the first ink area, such that the ink layer thicknesses are different. The first and second ink areas are separated by a sharp border line invisible on examination with the naked eye, and the ink layer thickness of both ink areas passes through a minimum in the region of the border line.

18 Claims, 1 Drawing Sheet

GRAVURE PROCESS FOR PRINTING ADJACENT COLOR SURFACES WITH VARIOUS COLOR COATING THICKNESSES

CROSS REFERENCE TO RELATED APPLICATION

This application is a divisional application of U.S. patent application Ser. No. 09/787,919 filed on Jun. 1, 2001 now U.S. Pat. No. 6,928,925.

BACKGROUND

The invention concerns a data medium with a printed image produced by the intaglio printing process, with adjacent ink areas with different ink layer thicknesses, an intaglio printing process for the printing of adjacent ink areas, as well as printing plates for carrying out the intaglio process and a process for the manufacture of the printing plates.

A characteristic of intaglio printing is that in the printing—that is, the colour transferring—areas, the surface material of a printing plate is removed by means of a suitable engraving tool or by etching. Ink is applied to the finished printing plate and the surplus ink is removed from the surface of the printing plate before the actual printing procedure by means of a doctor blade or a wiping cylinder, so that the ink remains only in the depressions. Then a substrate, usually paper, is pressed against the printing plate and then pulled off again, so that the ink remains adhering to the substrate surface and forms a print image there. If translucent inks are used, the thickness of the ink application determines the colour tone.

With previous gravure printing techniques, a distinction has been drawn between rotogravure and intaglio printing. In the case of rotogravure, the printing plates are made by means, for instance, of an electron beam, laser beam or graver. It is a characteristic of photogravure that different grey or colour scale values in the printed image are created by cells regularly arranged in the printing plate with varying density, size and/or depth.

The intaglio printing technique, and especially the steel-plate intaglio printing technique, is an important technique for the printing of data media, especially securities such as bank notes and the like. In comparison with other common printing techniques, such as offset printing, for instance, the intaglio printing process allows a very thick ink deposition onto data media. The relatively thick ink layer generated in the intaglio process is readily recognisable to the lay person as a simple authenticity feature, due to its tactile quality. This authenticity feature cannot easily be reproduced with a simple copy, so that the intaglio printing technique offers protection against simple forgeries.

Intaglio printing is distinguished by the fact that linear depressions are formed in the printing plates in order to create a print image. In the case of the mechanically produced intaglio printing plate, due to the normally conical shape of the engraving tool, increased engraving depth produces a broader line. Furthermore, the ink capacity of the engraved line and thus the opacity of the printed line increases with increasing line depth. For the etching of intaglio printing plates, the non-printing areas of the plate are covered with a chemically inert lacquer. During the subsequent etching, the engraving is created in the exposed areas of the plate, such as the depth of width of the engraved lines depend in particular on the etching duration.

A process is known from WO 97/48555, with which intaglio printing plates can be produced in a reproducible, mechanical manner. To that end, the lines on a line original are recorded and the area of every line is determined exactly. With an engraving tool, for instance a rotating graver or a laser beam, firstly the outer contour of this area is engraved, to provide a clean outline around the area. Next, the outlined region of the area is cleared out with the same or another engraving tool, so that the entire line is exactly engraved according to the line original. Depending on the shape and movement of the engraving tool, on the base of the cleared area, a floor roughness pattern is formed, which serves as an ink trap for the printing ink.

SUMMARY

It is possible, within a first engraved area, to engrave a second area with a greater engraving depth, so that, due to the different thicknesses of ink application, the printed image has two adjacent areas of differing colour intensity. Following the printing process, however, the differences of thickness become blurred, since the inks in the inked areas run into one another, with the result that a sharp optical separation between the inked areas in the printed image does not come about and thus no fine image structures can be reproduced.

It is therefore the aim of the present invention to provide measures that enable adjacent ink areas to be created with the intaglio printing process, which are clearly delimited from each other.

Of essential importance is the fact that in order to create adjacent areas of ink, the engraved areas on the printing plate assigned to colour areas are separated from each other with a separating edge, which is pointed at the level of the plate surface. If a data medium, such as a bank note, is printed with a printing plate of this type, then adjacent areas of ink are created which pass through a minimum in the border region.

In an ideal case, the ink layer thickness is zero at the border line between the areas of ink. However, if the printing inks in the adjacent areas of ink join each other in the immediate region of the border, it can be slightly greater than zero. This is especially the case if the flanks of the separating edge are steep and have a small flank angle. The flatter the flanks of the separating edge, the more gradually the ink layer thickness tends to the ink layer minimum thickness in the edge region. In this way, a very fine lighter border line, only perceptible under magnification, for instance with a magnifying glass, can be formed between the adjacent ink areas, which can serve as an additional—on normal observation, hidden—security feature.

By means of the invention, it is possible for the first time to create immediately adjacent ink areas with differing layer thicknesses using the intaglio printing process, which do not run into one another and are clearly delimited from each other.

Depending on the engraving depth, in this way, different colour tones can be created with the same printing ink. Using commercially available intaglio printing inks, engraving depths in the region of 5 to 60 μm lead to ink layers with a translucent, glazed colour appearance. In this connection, lighter colours are normally more strongly translucent than dark ones. With engraving depths of about 60 to 100 μm, on the other hand, ink layers with a more opaque coloured appearance result. Thus, using three different translucent printing inks, for instance, in combination with just two different engraving depths, six different colour tones can be produced in a single printing process. With an engraving depth of about 100 μm and above, the ink layers thereby produced on a printed document can be easily felt, so that using the printing plates according to the invention, not only the visual colour appearance, but also the tactile characteristics of a printed document can be specifically adjusted.

BRIEF DESCRIPTION OF THE DRAWINGS

The invention is described in more detail below with the aid of figures. The figures are sketches illustrating the principle and are not reproduced to scale, particularly with regard to the layer thicknesses.

They show the following.

DETAILED DESCRIPTION OF VARIOUS EMBODIMENTS

Figure 1:
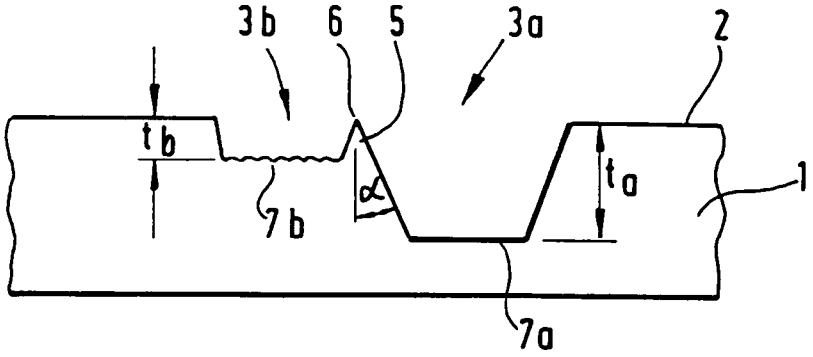
FIG. 1: Portion of a plate in cross-section.

FIG. 1 shows a printing plate 1 in cross-section with a printing plate surface 2, into which a first engraved area 3*a* with an engraving depth $t_a$ and a second engraved area 3*b* with an engraving depth $t_b$ are engraved. The two engraved areas 3*a*, 3*b* are immediately adjacent to each other at the level of the printing plate surface 2 and are otherwise separated from each other by a separating edge 5 whose upper edge 6 is pointed at the level of the printing plate surface 2. The printing plate can also be designed so that the upper edge 6 lies slightly—that is a few μm—below the level of the printing plate surface 2. The flanks of the engraved areas 3*a*, 3*b* also simultaneously form the flanks of the separating edge and subtend a flank angle to the perpendicular to the upper edge 6. In FIG. 1, only the flank angle α of the right flank of the separating edge is shown, since both the flank angles are equal in the example shown. The two flank angles of the separating edge 5 could, however, be made different. The flank angles can lie within the range of 15° to 60°, and preferably lie between 30° and 50°.

Comparisons have shown that printing plates with the preferred flank angle in the range between 30° and 50° have better printing qualities. These include a good edge sharpness in the printed image and a reduced tendency to ink spattering, leading to bleeding of the edges in the printed areas on the printed object.

The floor surfaces 7*a* and 7*b* of the engraved areas 3*a*, 3*b* can be flat (7*a*) or have a floor roughness pattern (7*b*). The floor roughness pattern is advantageous since the printing ink is held better on the floor of the engraving. The engraved areas 3*a* and 3*b* can also converge to a point at the bottom, so that they have no floor surface (not shown).

The engraving depth t of the engraved areas 3*a*, 3*b* lies in the region between 5 μm and 250 μm, and preferably in the range between 5 μm and 150 μm.

The engraved plates are also suitable for duplication by means of conventional moulding techniques for intaglio printing plates. In this way, the engraved original is reproduced multiple times by means of intermediate steps and only the reproductions used as printing forms. Engraving with the preferred flank angles and engraving depth have proved particularly advantageous for the moulding and separation procedures required for reproduction.

Figure 2:
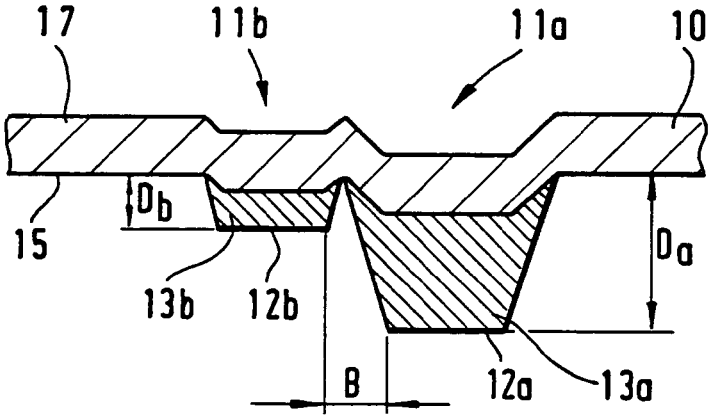
FIG. 2: Portion of a data medium with two adjacent ink layers with differing ink layer thicknesses, shown schematically in cross-section.

FIG. 2 shows a portion of a data medium 10 with a printed image including two ink areas 12*a*, 12*b*, shown in a schematically simplified form. The data medium 10 was printed with a printing plate 1 as shown in FIG. 1, using the intaglio printing process. During the printing process, the data medium 10 is pressed into the engraved areas 3*a*, 3*b*, such that on the underside 17 of the data medium, depressions 11*a*, 11*b* can remain lastingly. The upper surface 15 of the data medium has raised parts in the areas 11*a*, 11*b*, such that these raised parts are covered with ink layers 13*a*, 13*b*, which were taken up by the upper surface 15 of the data medium from the engraved areas 3*a*, 3*b*. The ink layers 13*a*, 13*b* form the ink areas 12*a*, 12*b* with their surfaces. The ink layer thickness $D_a$, $D_b$ is given by the level difference between the unprinted substrate surface and the surfaces of the respective ink areas 12*a*, 12*b*. In the border region B, the ink layer thicknesses $D_a$ and $D_b$ decrease continually towards a border line, which is defined by the upper edge 6 of the separating edge 5 of the printing plate 1. Depending on the flank angle α chosen and according to the engraving depth t, a more or less wide border region B is formed. Since the ink layer thicknesses $D_a$ and $D_b$ in the border region B decrease continually, by suitable choice of the flank angle α, a border line of light colour tone can be formed that is not discernible with the unaided human eye.

Figure 3:
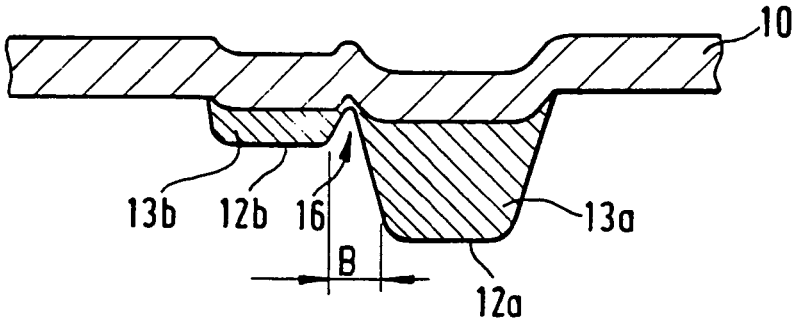
FIG. 3: Portion of a data medium with two adjacent ink layers in cross-section.

Ideally, the ink layer thicknesses $D_a$ and $D_b$ reduce at the border line to a minimum ink layer thickness of 0. However, slight combination of the ink areas 12*a*, 12*b* can take place without any discernible colour mixing taking place. FIG. 3 illustrates this case. It can be seen that at the border line 16, combination of the ink areas 12*a* and 12*b* has taken place.

The ink layers 13*a* and 13*b* can consist of printing inks of different colour, since mixing of the inks in different engraving areas is practically non-existent, because of the design of the printing plate according to the invention. If, however, the same translucent printing ink is used for the adjacent engraved areas 3*a*, 3*b* with different engraved depths $t_a$, $t_b$, the ink layers 13*a* and 13*b* produce different colour tones in the printed image.

The adjacent engraved areas can be made up of lineshaped or planiform depressions. The depressions are preferably engraved with a rotating graver having a flank angle corresponding to the required flank angle of the separating edge. Alternatively, the engraving graver can also be moved along paths forming two systems. The curves or straight lines of a system run parallel to each other and cross the curves or straight lines of the second system at regular intervals. In this way, a floor roughness pattern in the form of a grid pattern with particularly favourable ink trapping properties is formed. Preferably, the graver comes to a point or has a special contour which allows a floor roughness pattern to be created on the floor surface of the engraving, this serving as an ink trap. To this end, the graver is moved at regular, small distances parallel to a previously engraved path, so that the previously engraved depression is widened by this distance. The engraving depth lies in the region of 5 to 250 μm, and preferably 50 to 150 μm.

The preferred flank angle in the region of 30° to 50° enables a longer working life for the engraving tool, while simultaneously producing an excellent printing result from the engraved printing plate. Tools with flank angles in the region of 30° are particularly suited to the engraving of fine filigree and small-area structures, while for the engraving of large-area and coarser structures, tools with flank angles of 40° to 50° are preferable.

One or more lineshaped or planiform depressions can represent a pattern, a graphical symbol or a text symbol. Multiple adjacent depressions can form a regular grid, so that the printed image produced appears homogeneous, whereby the grid creates a fine structure in the printed image, which is only perceptible using magnifying devices.

The invention claimed is:

1. A printing plate for the printing of adjacent ink areas, comprising a generally planar printing plate surface and engraved in the printing plate surface, at least one first engraving area with a first engraving depth and at least one second engraving area with a second engraving depth adjacent to the first engraving area, such that the engraving, depths are different, and wherein, between the first and the second engraved areas, is arranged a separating edge the upper edge of which extends up to a point substantially at the level of the printing plate surface.

2. The printing plate according to claim 1, wherein the separating edge has flank angles in the region between 15° and 60°, preferably between 30° and 50°, relative to the perpendicular to the printing plate surface.

3. The printing plate according to claim 1 or 2, wherein the first and second engraving depths lie in the region between 5 and 250 μm.

4. The printing plate according to claim 3, wherein the first and second engraving depths lie in the region between 5 and 150 μm.

5. The printing plate according to claim 1 or 2, wherein the first engraved area and/or the second engraved area are forms selected from the group consisting of a pattern, a graphical symbol and a text symbol.

6. The printing plate according to claim 1 or 2, wherein the first and/or the second engraved area have a floor area having a floor roughness pattern.

7. An intaglio printing process comprising printing of adjacent ink areas with different ink layer thicknesses using a printing plate according to claim 1 or 2.

8. The printing plate according to claim 1 or 2, wherein the engraved areas are formed by linear or areal depressions.

9. A process for the manufacture of a printing plate for the printing of adjacent ink areas with different ink layer thicknesses, comprising the following steps:

providing a printing plate with a generally planar printing plate surface; and engraving a first engraving area with a first engraving depth and a second engraving area with a second engraving depth in the printing plate surface, such that between the first engraving area and the second engraving area, a separating edge remains, said separating edge having an upper edge which extends up to a point substantially at the height of the printing plate surface.

10. The process according to claim 9, wherein the separating edges are formed with flank angles in the region of 15° to 60°, preferably 30° to 50° relative to the perpendicular to the printing plate surface.

11. The process according to claim 9 or 10, wherein an engraving tool with a suitable flank angle is used for engraving.

12. The process according to claim 11, wherein a rotating graver coming to a point is used for engraving.

13. The process according to claim 9 or 10, wherein the engraving depths are created in the region from 5 μm to 250 μm.

14. The process according to claim 13, wherein the engraving depths lie in the region from 5 μm to 150 μm.

15. The process according to claim 9 or 10, wherein in the first engraving area and/or in the second engraving area, a floor area with a floor roughness pattern is created.

16. The process according to claim 9 or 10, wherein several adjacent first engraving areas and one or more adjacent second engraving areas are engraved in the printing plate surface.

17. The process according to claim 9 or 10, wherein the first or the several first engraving areas and/or the second or the several second engraving areas are arranged in the form of a pattern, graphical symbol or text symbol.

18. The process according to claim 9, including forming the engraved areas by linear or areal depressions.

* * * * *